US010541469B2

(12) United States Patent
Fabre et al.

(10) Patent No.: US 10,541,469 B2
(45) Date of Patent: Jan. 21, 2020

(54) ANTENNA FOR MOTOR VEHICLES AND ASSEMBLING METHOD

(71) Applicant: Advanced Automotive Antennas, S.L.U., Barcelona (ES)

(72) Inventors: Pere Mogas Fabre, Barcelona (ES); Enrique Martínez Ortigosa, Barcelona (ES); Laura Tantiñá Cuni, Barcelona (ES); Ramiro Quintero Illera, Barcelona (ES); Carlos López Rodríguez, Barcelona (ES); Lucía Garrido González, Barcelona (ES)

(73) Assignee: ADVANCED AUTOMOTIVE ANTENNAS, S.L.U., Barcelona (ES)

( * ) Notice: Subject to any disclaimer, the term of this patent is extended or adjusted under 35 U.S.C. 154(b) by 124 days.

(21) Appl. No.: 15/359,713

(22) Filed: Nov. 23, 2016

(65) Prior Publication Data

US 2017/0149124 A1 May 25, 2017

(30) Foreign Application Priority Data

Nov. 24, 2015 (EP) ..... 15195995

(51) Int. Cl.
*H01Q 1/32* (2006.01)
*H01Q 1/42* (2006.01)

(52) U.S. Cl.
CPC ..... *H01Q 1/3291* (2013.01); *H01Q 1/3275* (2013.01); *H01Q 1/42* (2013.01)

(58) Field of Classification Search
CPC ..... H01Q 1/3291; H01Q 1/3275
See application file for complete search history.

(56) References Cited

U.S. PATENT DOCUMENTS

| | | | | |
|---|---|---|---|---|
| 8,368,609 | B2 | 2/2013 | Morrow et al. | |
| 2010/0231467 | A1* | 9/2010 | Schnuerer | H01Q 1/1214 343/713 |
| 2013/0229315 | A1* | 9/2013 | Duzdar | H01Q 1/3275 343/713 |
| 2015/0123854 | A1* | 5/2015 | Chakam | H01Q 1/1214 343/702 |
| 2016/0036121 | A1* | 2/2016 | Hayashi | H01Q 1/42 343/713 |
| 2017/0054204 | A1* | 2/2017 | Changalvala | H01Q 1/3291 |
| 2017/0207520 | A1* | 7/2017 | Ohno | H01Q 1/3275 |

* cited by examiner

*Primary Examiner* — Ricardo I Magallanes
(74) *Attorney, Agent, or Firm* — Cantor Colburn LLP

(57) ABSTRACT

An antenna for motor vehicles is provided having a base member, an antenna device, a radome, and a device for attaching the base member to a vehicle roof inside surface with the antenna device projecting outwards of the vehicle from within through an opening formed in the vehicle. The radome cooperates with the attaching device and the surroundings of the vehicle opening so as to enclose the antenna device in an assembled condition.

10 Claims, 2 Drawing Sheets

ANTENNA FOR MOTOR VEHICLES AND ASSEMBLING METHOD

CROSS-REFERENCES TO RELATED APPLICATIONS

This patent application claims priority to European Patent Application No. EP15195995.4, filed Nov. 24, 2015 which is incorporated herein by reference in its entirety.

BACKGROUND OF THE INVENTION

The present disclosure relates to antennas for motor vehicles and methods for assembling such antennas in a motor vehicle.

Antennas intended to be mounted on motor vehicles are known in the art. Such antennas mainly comprise a base member, an antenna device mounted thereon, and an attaching device for attaching the base member to a part of a vehicle. An external cover is usually provided for covering the antenna device in order to protect the inner parts from damages.

One example of such antennas for motor vehicles where the base member is adapted to be attached to a portion of a vehicle is disclosed in U.S. Pat. No. 7,304,614. The base member is attached to the roof of the vehicle by preassembling the base member on top of the roof and then securing the base member thereto through a fastening screw.

The assembly of the antenna on a motor vehicle from the outside has been shown to involve sealing problems. Tightness between the external cover and the antenna device has been shown not to be entirely adequate in all conditions.

U.S. Pat. No. 8,368,609 shows an omnidirectional antenna that can be mounted in a vehicle roof through the use of mounting clips or adhesives. In this case, the antenna is mounted from the inside of the motor vehicle such that it is suspended from the vehicle roof.

Suspended antenna attachments are complex. In addition, even though both inner and outer sealing means are applied, absolute tightness cannot be ensured in all conditions, especially with regard to the base member and the parts of the antenna device mounted thereon.

A need therefore exists for an improved antenna for motor vehicles which may provide high efficiency in sealing while being easy, simple and fast to assemble to a vehicle.

SUMMARY OF THE INVENTION

An antenna for motor vehicles is disclosed herein with which the problems related to prior art antennas are overcome and with which a number of advantages are obtained.

The present antenna is intended to be mounted on a vehicle roof although it can be mounted on any other parts of a vehicle. The present antenna has a base member intended to be attached to a part of a motor vehicle, for example the roof as mentioned above. The base member is adapted for receiving an antenna device such that it is connected thereto. The antenna device may include therein antenna parts as required such as means for receiving and/or sending communication signals, a processor for processing communication signals, a main circuit board, and other elements such as GPS modules and so forth.

An attaching device is provided for attaching the base member to an inside surface of a vehicle. As used herein, an inside surface of a vehicle refers to a part within the vehicle, such as an inner part of the vehicle roof. However, other different locations within a motor vehicle where the present antenna can be attached are also possible.

Attachment of the base member to an inside surface of a vehicle is carried out such that, in an operating condition, that is, with the antenna assembled ready for operation, the antenna device projects outwards the vehicle from within through an opening that is formed in the vehicle for that purpose.

Electrical contact means are provided for suitable electrical contact of the base member with the vehicle. Such electrical contact means are sized and arranged for allowing the antenna device to be suitably grounded to the motor vehicle. The contact means may be one or more metal elements projecting outwards from the base member, such as for example electrical contact pins spaced apart from each other, a continuous a metal plate, or a combination of metal plates and contact pins.

The feature that the attaching device is adapted for attaching the base member to an inside surface of a vehicle has been proven to be very advantageous in terms of efficiency of sealing the antenna device. Attachment of the antenna to the motor vehicle is carried out only between the base member and the motor vehicle, with no additional parts required to be involved.

In one example, the antenna may further comprise an external cover or radome arranged over the antenna device for covering the interior parts thereof and for protecting them from damages from outside the vehicle such as weather, dirt, impacts, etc. The radome may be a decorative cover which is preferably sized and shaped to match the overall vehicle appearance, lines and aerodynamics. For example the radome may be shark fin shaped. In any case, it is preferred that the radome is configured to cooperate with the attaching device and the surroundings of the vehicle opening so as to enclose the antenna device in an assembled condition. More preferably, the radome is configured to sealingly enclose the antenna device in the assembled condition in order to ensure good protection of parts thereof from damages from outside the vehicle.

The attaching device may for example comprise a set of tabs or clips made of an elastic material such as for example plastics, metal or any suitable material or combinations of materials. The elasticity of the tabs or clips is such that they are suitable for locking the base member to the vehicle, for example the roof, through their thrusting action along directions extending outwards the perimeter of the opening. Thus, the elastic tabs or clips allow the base member with the antenna device to be preassembled to the vehicle while allowing time for definitive attachment of the attaching device, specifically allowing time for definitive attachment of adhesive elements which will be described below. Other types of definitive attachments are not ruled out such as screwing or riveting.

In one example, the elastic tabs may be arranged at least substantially surrounding the antenna device. Other arrangements of the set of elastic tabs relative to the antenna device are not ruled out such as for example with the tabs covering only one side of the antenna device perimeter.

In some examples, the attaching device may additionally or alternatively comprise at least one foam element for absorbing vibrations when the antenna is in an assembled condition. The foam element or elements may be arranged in the base member contacting the inside surface of the vehicle.

The attaching device may additionally or alternatively comprise at least one of a first adhesive element and a second adhesive element. At least one of such first and second adhesive elements may be for example a suitable adhesive sealing joint.

In the example where the attaching device comprises a first adhesive element, it may be adapted to be arranged between the base member and the inside of the vehicle in an assembled condition, that is, between the base member and a vehicle inside surface.

In the example where the attaching device comprises a second adhesive element, it may be adapted to be arranged between the radome and the outside of the vehicle in an assembled condition, that is, between the radome and a vehicle outside surface.

The radome thus serves the purpose of protecting the inside parts of the antenna device while sealing the assembly against the vehicle, such as for example the roof, through the above mentioned second adhesive element. If required, sealing material such as silicone can be applied, in addition to the second adhesive element, around the attachment between the radome and the vehicle.

At least one of said first and second adhesive elements may be arranged at least substantially surrounding the antenna device. Other arrangements for the at least one of the first and second adhesive elements relative to the antenna device are not ruled out such as for example covering only one side of the antenna device perimeter.

An internal cover may be also included. Such internal cover may be arranged over the antenna device within the radome. The internal cover may include an attaching portion for attachment of the internal cover to the base member.

In one preferred example, the internal cover may be integrally formed with the base member. However, the base member and the internal cover may be separate parts attached to each other by any suitable means.

Assembling the above described antenna is very quick, simple and efficient. An antenna device is attached to a base member and then the antenna device is passed outwards from within the motor vehicle through an opening in the vehicle. The base member is then attached to an inside surface of the vehicle through the above mentioned attachment device, by first preassembling the base member by the elastic tabs, if provided. Then, the base member is definitively attached to the inside surface of the vehicle by adhesive elements such that, in operation, the antenna device projects outwards of the vehicle from the inside. The radome is then attached to an outside surface of the vehicle, such as for example the roof, so that the antenna device is sealingly enclosed therein. Permanent sealing means can be then applied to the inside and outside surfaces of the vehicle.

To increase sealing efficiency, the surroundings of the vehicle opening are stamped to provide a substantially flat surface where the first and second adhesive elements are adhered. This increases the contact surface between the attachment device, the base member and the external cover or radome, if present. This is particularly advantageous when adhesive elements are provided to definitively attach the antenna device to the vehicle.

One advantage of the assembling method of the above described antenna is that, once assembled, the radome is not attached to the base member but to the vehicle. This results in highly improved sealing and tightness.

Additional objects, advantages and features of examples of the present antenna for motor vehicles and assembling method will become apparent to those skilled in the art upon examination of the description, or may be learned by practice thereof.

BRIEF DESCRIPTION OF THE DRAWINGS

Particular examples of the present antenna for motor vehicles will be described in the following with reference to the appended drawings, in which.

DETAILED DESCRIPTION OF THE INVENTION

Figure 1:
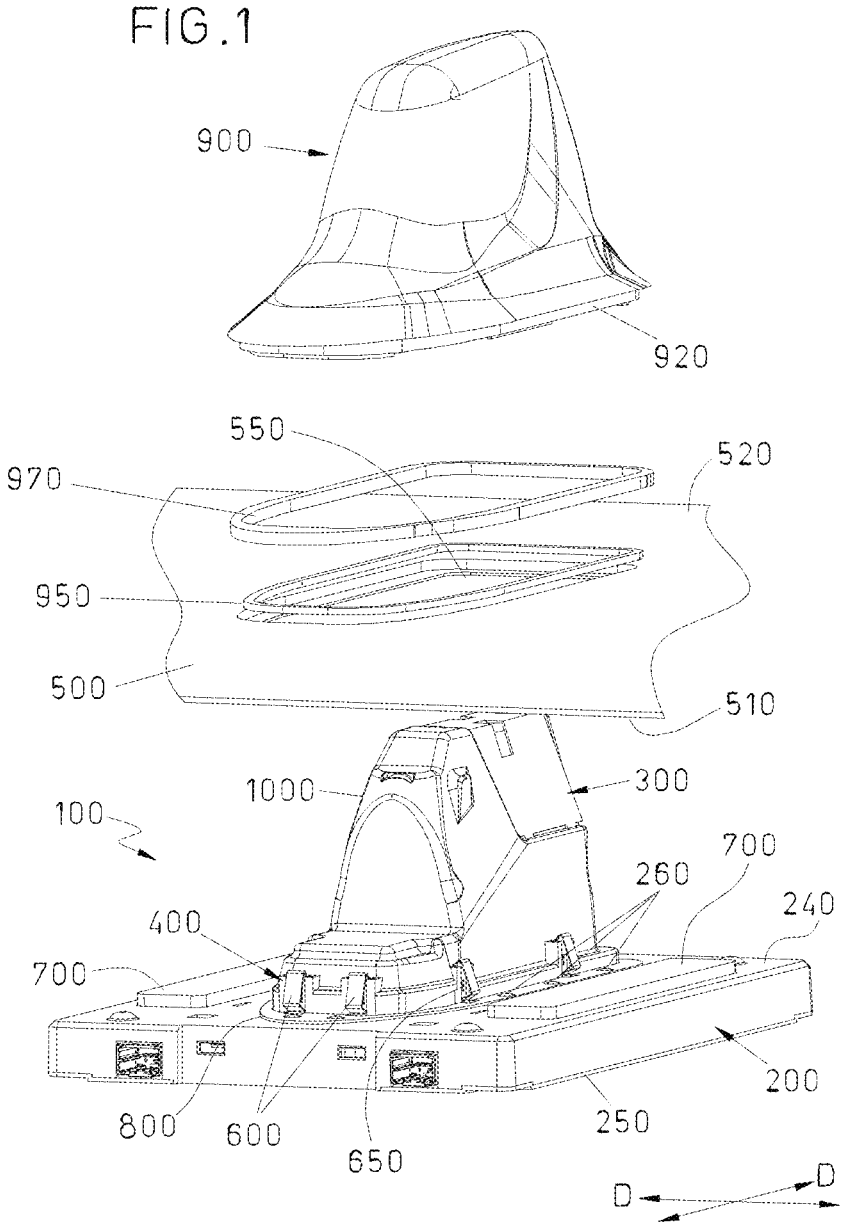
FIG. 1 diagrammatically shows a perspective exploded view of one example of an antenna for motor vehicles.

A perspective exploded view is shown in FIG. 1 of one example of the present antenna which has been generally illustrated by reference numeral 100. The antenna 100 of the example illustrated is intended to be mounted on a vehicle roof 500 so it will be referred hereafter to as roof antenna 100. The roof antenna 100 comprises a base member 200, an antenna device 300, an external cover or radome 900, an internal cover 1000 and a base member attaching device 400.

Figure 2:
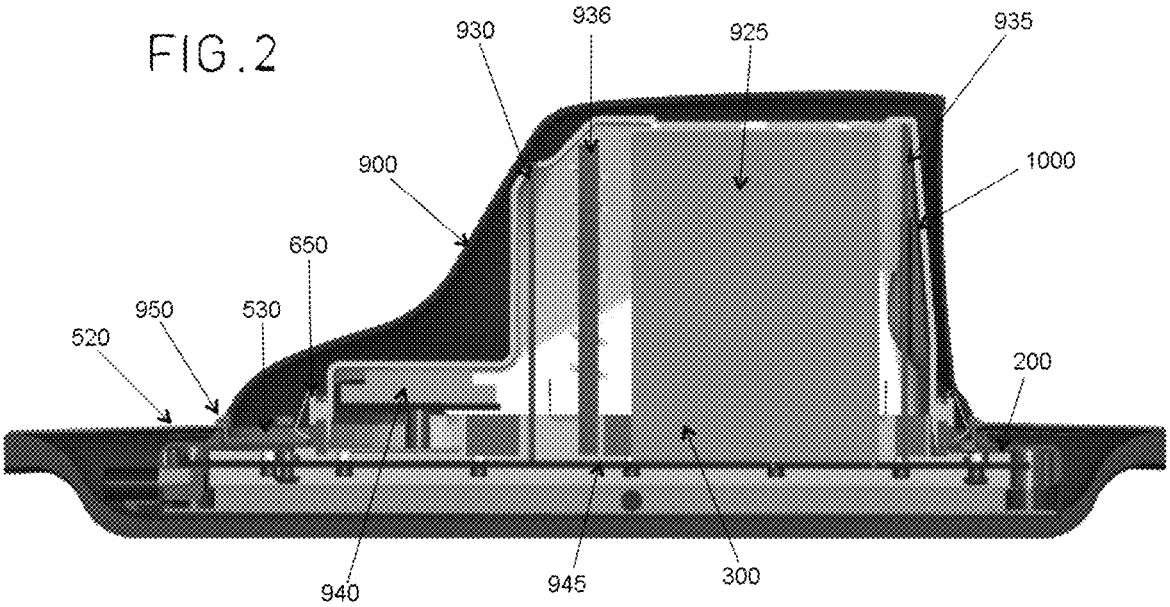
FIG. 2 is a sectional view of a first example where the radome and the base member are separate parts.

The base member 200 and the internal cover 1000 may be separate parts attached to each other by any suitable means, as shown in the example shown in FIG. 2. However, the base member 200 may be integrally formed with the internal cover 1000 as shown in the example shown in FIG. 3.

In both cases, the base member 200 is provided with a detachable bottom portion 250 which serves the purpose of allowing the interior of the cover 1000 to be accessed.

The antenna device 300 is connected to the base member 200 and attached thereto such that, in an assembled or operating condition, the antenna device 300 projects outwards the vehicle through an opening 550 that is formed in the vehicle roof 500.

In any of the examples shown in the figures, the interior of the cover 1000 is adapted for receiving a number of antenna parts of the antenna device 300.

Figure 3:
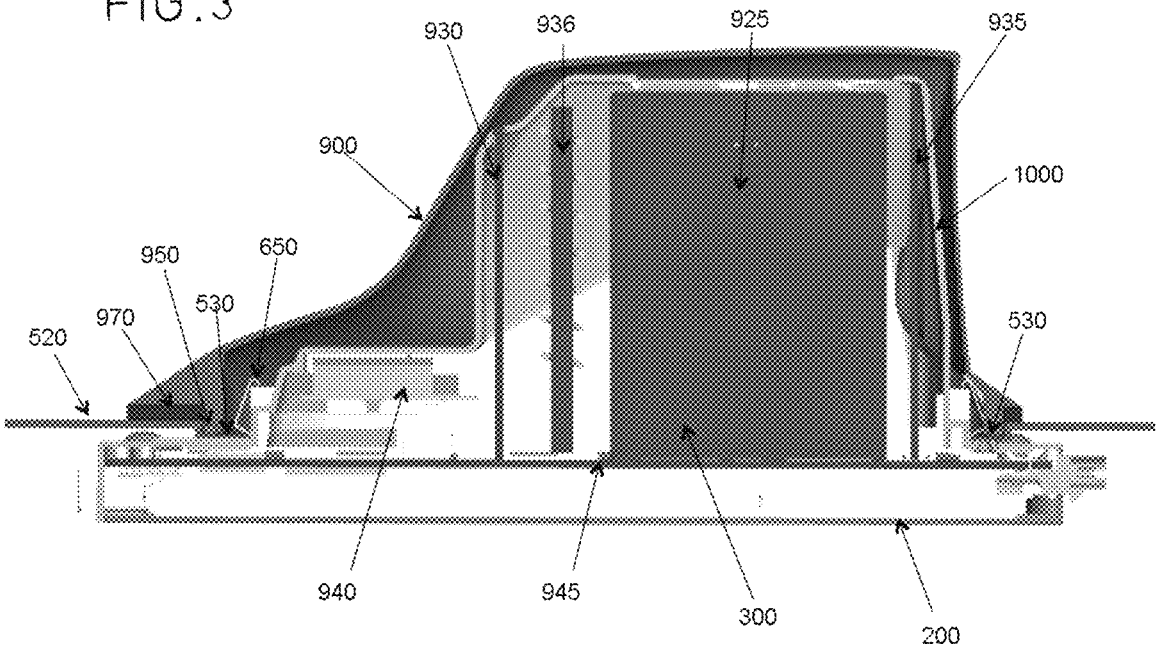
FIG. 3 is a sectional view of a second example where the radome and the base member are integrally formed with each other.

Some of such antenna parts have been diagrammatically illustrated in FIGS. 2 and 3. For example, the antenna device 300 in the example shown includes an AM/FM radio device 925, a wireless communication device such as Long-Term Evolution devices 930, 935, a GPS with a Digital Audio Radio Service (DARS) radio device 940, a PCB circuit board 945, and other elements such as at least one processor for processing communication signals, etc. depending on the specific requirements of the vehicle antenna. In the example shown in FIG. 2 where the base member 200 and the internal cover 1000 are separate parts, the circuit board 945 is encapsulated inside the base member 200. Instead, in the example shown in FIG. 3 where the base member 200 is integrally formed with the internal cover 1000, the circuit board 945 is received inside the internal cover 1000 and is in turn attached to the base member 200. Thus, in this case, the base member 200 is encapsulated between the base member 200 and the internal cover 1000.

The radome 900 is a shark fin shaped piece that is suitably configured to cooperate with the attaching device 400, which will be described further below, and the surroundings of the vehicle roof opening 550. Specifically, the shark fin shaped radome 900 shown in the drawing is configured to sealingly enclose the antenna device 300 in an assembled condition, that is, when the roof antenna 100 has been installed and is ready for operation. In said assembled condition, the radome 900 is arranged over the antenna device 300 covering and protecting the above mentioned antenna device parts from damages, weather, etc.

Electrical contact means 260 are provided for electrical contact of the base member 200 with the vehicle. Specifically, the electrical contact means 260 are provided for allowing the antenna device 300, i.e. the circuit board 945, to be grounded to the motor vehicle.

In the specific example shown in FIG. 1 of the drawings, the electrical contact means comprise a number of electrical contact pins 260 projecting outwards from the base member 200. Such contact pins 260 are attached on a top portion 240 of the base member 200 in the vicinity of the internal cover 1000 in a manner suitable to prevent undesired resonances. The electrical contact pins 260 are distributed around the outer perimeter of the internal cover 1000 and spaced apart from each other a suitable separation distance. Such separation distance is preferred to be less than half the wavelength of the highest operating frequency of the antenna device 300. For example, in the case of a LTE2600 working at a frequency of 3 GHz, the separation distance between electrical contact pins 260 is less than 50 mm.

Alternatively it is also envisaged that the electrical contact means 260 are continuous. In this case, for example, the electrical contact means 260 may be a metal plate projecting outwards from the base member 200. The metal plate would be attached on a top portion 240 of the base member 200 surrounding the internal cover 1000 in a manner suitable to prevent undesired resonances. A combination of metal plates and contact pins is also possible as long as an electrical continuity exists between the base member 200 and the vehicle, such as the vehicle roof 500.

A device 400 for attaching the base member 200 to an inside surface 510 of a vehicle roof 500 is provided in the present roof antenna 100. In the specific example shown, the attaching device 400 comprises a set of elastic tabs or clips 600, two foam elements 700 and a plurality of adhesive elements.

The set of elastic tabs or clips includes eight stainless steel elastic tabs 600. The elastic tabs 600 are configured for allowing preassembly or pre-attachment of the base member 120, with the antenna device 300, in the vehicle roof opening 550. The preassembly or pre-attachment function of the base member 120 by the elastic tabs 600 allows time for definitive attachment of the base member 120 by the adhesive elements as it will be explained hereinbelow.

For this purpose, the elastic tabs 600 are arranged surrounding the antenna device 300 such that they are ready for locking the base member 200 to the vehicle roof opening 550. This is carried out by a thrusting action exerted by the tabs 600 along directions D extending outwards the perimeter of the vehicle roof opening 550.

The elastic tabs 600 are adapted to be received into tab housings 650 formed around the antenna device 300. Tab housings 650 are formed into a guided shape and a stop contact is provided therein to ensure that the elastic tabs 600 can be received properly into the corresponding tab housings 650 in any condition even if the elastic tabs 600 become deformed upon assembly of the roof antenna 100.

The foam elements 700 are intended for absorbing vibrations when the roof antenna 100 is assembled. The foam elements 700 are arranged in the base member 200 contacting the inside surface 510 of the vehicle roof 500.

In the example herein described, a plurality of adhesive elements are provided for suitably attaching the base member 200 to the inside surface 510 of the vehicle roof 500. In the example shown in FIG. 1 of the drawing, the adhesive elements are sealing joints and at least one of them is a self-adhesive sealing joint arranged surrounding the antenna device 300.

A first adhesive element 800 is arranged between the base member 200 and the inside surface 510 of the vehicle roof 500. A second adhesive element 950 is arranged between the radome 900 and the outside surface 520 of the vehicle roof 500, and it is intended to be fitted in the vehicle roof opening 550 for properly sealing it. The second adhesive element 950 is adapted to act as a seat for radome 900. A third adhesive element 970 is arranged surrounding a perimetric recess 920 of the radome 900 as shown in FIG. 1. In the example of FIG. 2, the third adhesive element 970 is not provided.

The first and second adhesive elements 800, 950 are received into shaped channels, not shown, formed in the base member 200 and the radome 900, respectively. Alternatively or additionally, the shaped channels might be formed in the inside and outside surfaces 510, 520 of the vehicle roof 500, respectively. In any case, the geometry of said channels is adapted to enhance sealing of the base member 200 and the radome 900.

The internal cover 1000 is adapted to be mounted over the antenna device 300 within the radome 900. An attaching portion, not shown, is provided in the internal cover 1000 for attachment to the base member 200.

The method for assembling the above roof antenna 100 is as follows.

The antenna device 300 is connected to the base member 200. A protective sheet is removed from the first adhesive element 800 and then the base member 200 is placed under the vehicle roof opening 550 and the antenna device 300 is passed through the vehicle roof opening 550 outwards the vehicle. Elastic tabs 600 then begin to deform as they are urged along directions extending inwards the perimeter of the vehicle roof opening 550.

While the antenna device 300 is being still passed through the vehicle roof opening 550 outwards the vehicle, elastic tabs 600 continue to deform until they become attached to the vehicle roof 500, which can be confirmed by a click sound. The base member 200 is still pressed by the operator against the vehicle roof inside surface 510 in order to enhance effectiveness of the first adhesive element 800.

Thereafter, the tabs 600 become received in the corresponding housings 650 in the antenna device 300 such that they return back to their original shape, locking the base member 200 with the antenna device 300 in position by interference with the vehicle roof opening 500.

Finally, a protective sheet is then removed from the second and third adhesive elements 950, 970 and the radome 900 is placed covering the antenna device 300.

The radome 900 is pressed by the operator against the vehicle roof outside surface 520, specifically against a corresponding roof print, until the radome 900 becomes fixed thereto.

Preferably, the surroundings of the vehicle roof opening 550 are stamped to provide a substantially flat surface to which the first and second adhesive elements 800, 950 are adhered. After stamping, the previous assembling method is performed.

The invention claimed is:

1. An antenna adapted to be installed in a vehicle, the antenna comprising:

a base member;

an antenna device preassembled and connected to the base member;

an attaching device including a plurality of resiliently flexible tabs adapted for attaching the antenna device and the base member to the vehicle with the base member being opposed to an inside surface of the vehicle with the antenna device projecting outwards and through an opening formed in the vehicle when in an assembled condition; and a radome arranged over the antenna device, the radome configured to cooperate with the attaching device and adapted to cooperate with an outside surface of a roof of the vehicle so as to enclose the antenna device in the assembled condition.

2. The antenna according to claim 1, where the radome is configured to sealingly enclose the antenna device in an assembled condition.

3. The antenna according to claim 1, where the attaching device comprises at least one foam element arranged at the base member to contact the inside surface of the vehicle for absorbing vibrations in an assembled condition.

4. The antenna according to claim 1, where the attaching device comprises a second adhesive element adapted to be arranged between the radome and the outside surface of the vehicle in an assembled condition.

5. The antenna according to claim 1, where the attaching device comprises a first adhesive element adapted to be arranged between the base member and the inside surface of the vehicle in an assembled condition or the attaching device comprises a second adhesive element adapted to be arranged between the radome and the outside surface of the vehicle in an assembled condition, and where at least one of the first or second adhesive elements, respectively, is arranged at least substantially surrounding the antenna device.

6. The antenna according to claim 1, where the attaching device comprises a first adhesive element adapted to be arranged between the base member and the inside surface of the vehicle in an assembled condition or the attaching device comprises a second adhesive element adapted to be arranged between the radome and the outside surface of the vehicle in an assembled condition, and where at least one of the first and second adhesive elements is an adhesive sealing joint.

7. An antenna adapted to be installed in a vehicle, the antenna comprising:

a base member;

an antenna device connected to the base member when in a preassembled condition and as one unitary part;

an attaching device including a plurality of elastic clips engaged to the one unitary part and adapted to resiliently flex as the antenna device is inserted through an opening formed in the vehicle, the base member being opposed to an inside surface of the vehicle when in an assembled condition;

a radome arranged over the antenna device and configured to cooperate with the attaching device and surroundings of the vehicle opening so as to enclose the antenna device when in an assembled condition; and an internal cover arranged over the antenna device within the radome and engaged to the base member.

8. The antenna according to claim 7, where the internal cover includes an attaching portion for attachment of the internal cover to the base member.

9. The antenna set forth in claim 7, wherein the internal cover is integrally formed to the base member.

10. An antenna adapted to be installed in a vehicle, the antenna comprising:

a base member;

an antenna device connected to the base member;

an attaching device engaged to the base member and adapted to attach to an inside surface of the vehicle with the antenna device projecting outwards and through an opening formed in the vehicle when in an assembled condition;

an electrical contact means for electrical contact of the base member with the vehicle; and a plurality of electrical contact pins projecting outwards from the base member for electrical contact with the vehicle wherein the plurality of electrical contact pins are distributed around an outer perimeter of the internal cover, and the plurality of electrical contact pins are spaced apart from one-another by equal to or less than half a wavelength of a maximum operating frequency of the antenna.

* * * * *